United States Patent [19]

Ruckdeschel

[11] 4,139,296

[45] Feb. 13, 1979

[54] CROSS MIXER

[75] Inventor: Frederick R. Ruckdeschel, Webster, N.Y.

[73] Assignee: Xerox Corporation, Stamford, Conn.

[21] Appl. No.: 811,810

[22] Filed: Jun. 30, 1977

[51] Int. Cl.[2] ..... G03G 15/09

[52] U.S. Cl. ..... 355/3 DD; 118/657

[58] Field of Search ..... 118/622, 624, 648, 651, 118/657, 658; 355/3 DD

[56] References Cited

U.S. PATENT DOCUMENTS

| | | | |
|---|---|---|---|
| 3,464,383 | 9/1969 | Knechtel | 118/657 |
| 3,557,751 | 1/1971 | Kushima et al. | 118/657 |
| 3,777,707 | 12/1973 | Hodges | 355/3 DD |
| 4,067,296 | 1/1978 | Sessink | 355/3 DD |
| 4,080,054 | 3/1978 | Watanabe | 355/3 DD |

*Primary Examiner*—A. D. Pellinen

*Attorney, Agent, or Firm*—J. J. Ralabate; C. A. Green; H. Fleischer

[57] ABSTRACT

An apparatus in which particles are mixed. The particles are disposed in an inner member having an outer member spaced therefrom and positioned concentrically thereover. A helical magnetic pole pattern is impressed on the outer member. Relative angular rotation between the outer member and the inner member translates the particles generating mixing therebetween.

6 Claims, 3 Drawing Figures

CROSS MIXER

BACKGROUND OF THE INVENTION

This invention relates generally to an electrostatographic printing machine, and more particularly concerns an improved cross-mixer for use in the development system employed therein.

In the process of electrostatographic printing, electrostatic charge patterns are formed and reproduced in viewable form. The field of electrostatography includes electrophotography and electrography. Electrophotography employs a photosensitive medium to form, with the aid of electromagnetic radiation, the electrostatic latent charge pattern. Electrography utilizes an insulating medium to form, without the aid of electromagnetic radiation, the electrostatic latent charge pattern. Development, which is the act of rendering an electrostatic latent image or pattern visible, is employed in all of the aforementioned types of electrostatographic printing. Hereinafter, an electrophotographic printing machine will be described as the illustrative embodiment having the features of the present invention incorporated therein.

An electrophotographic printing machine employs a phooconductive member which is charged to a substantially uniform potential so as to sensitize the surface thereof. The charged portion of the photoconductive member is exposed to a light image of an original document being reproduced. As a consequence of the exposure, the charge is selectively dissipated in the irradiated areas in accordance with the light intensity reaching the surface thereof. This records an electrostatic latent image on the photoconductive surface. Development of the electrostatic latent image recorded on the photoconductive surface is achieved by bringing a developer mix adjacent thereto. A typical developer mix comprises dyed or colored plastic particles, known in the art as toner particles, which are mixed with coarser carrier granules, such as ferromagnetic granules. In general, the toner particles are heat-settable. The toner particles and carrier granules are selected so that the toner particles have the appropriate charge relative to the electrostatic latent image recorded on the photoconductive surface. Thus, when the developer mix is adjacent to the photoconductive surface, the greater attractive force of the latent image recorded thereon causes some of the toner particles to transfer from the carrier granules and adhere thereto. This concept was originally disclosed by Carlson in U.S. Pat. No. 2,297,691 and is further amplified and described by many related patents in the art.

In electrophotographic printing, excessive developer mix is positioned adjacent the electrostatic latent image. The unused developer mix and denuded carrier granules are returned to the sump thereof for subsequent reuse. Mixing of the unused developer mix and denuded carrier granules with new toner particles is promoted by cross-mixing the foregoing with one another. This insures that the triboelectric characteristics will be satisfied. Various types of mixing devices have been developed. For example, structured baffle plates are frequently used when passive cross-mixing is desired. Alternatively, active cross-mixers such as auger systems may be employed to maintain a more or less uniform distribution of the toner particles throughout the developer mix. In this way, the developer mix may be recirculated numerous times without a marked reduction in the quality of the copies being reproduced.

Accordingly, it is a primary object of the present invention to improve active cross-mixers employed in the development system of electrophotographic printing machine.

PRIOR ART STATEMENT

Various types of devices have hereinbefore been developed to improve crossmixing. The following prior art appears to be relevant:

Smith, U.S. Pat. No. 3,947,107; 1976

The pertinent portions of the foregoing prior art may be briefly summarized as follows:

Smith discloses an active cross-mixer comprising a pair of rotatably driven augers and a baffle for partially submerging the augers in the developer mix. The system is located so as to intercept the developer mix returning from the development zone and any additional toner particles added thereto so as to maintain the toner concentration at a suitably high level. The developer mix is divided between the pair of augers which, in turn, laterally transport the developer mix in opposite directions. The baffle is apertured so that the developer mix not only flows over the ends of the baffle but also through the baffle thereby distributing the developer mix substantially uniformly across the full width of the sump.

SUMMARY OF THE INVENTION

Briefly stated, and in accordance with the present invention, there is provided an apparatus for mixing magnetic particles.

Pursuant to the features of the invention, the apparatus includes an inner member having the particles disposed therein. An outer member is positioned concentrically over the inner member. The outer member has a helical magnetic pole pattern impresssed thereon. Means are provided for generating relative angular rotation between the inner member and the outer member to translate the particles along the inner member.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
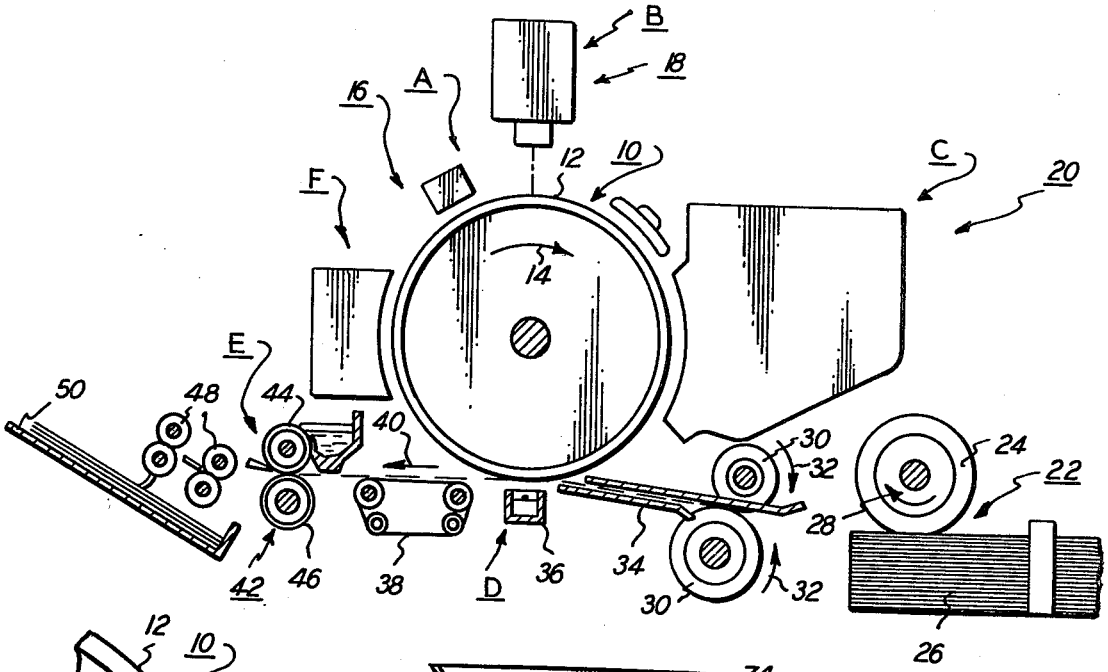
FIG. 1 is a schematic elevational view depicting an electrophotographic printing machine incorporating the features of the present invention therein.

For a general understanding of an electrophotographic printing machine in which the features of the present invention may be incorporated, reference is had to FIG. 1 which depicts schematically the various components thereof. Hereinafter, like reference numerals will be employed throughout to designate identical elements. Although the apparatus for cross-mixing toner particles with carrier granules is particularly well adapted for use in a development system employed in the electrophotographic printing machine, it should become evident from the following discussion that it is equally well suited for use in a wide variety of devices and is not necessarily limited in its application to the particular embodiment shown herein.

Inasmuch as the practice of electrophotographic printing is well known in the art, the various processing stations for producing a copy of an original document are represented schematically in FIG. 1. Each processing station will be briefly described hereinafter.

As in all electrophotographic system of the type illustrated, a drum 10 having a photoconductive surface 12 entrained about and secured to the exterior circumferential surface of a conductive substrate is rotated in the direction of arrow 14 through the various processing stations. One type of suitable photoconductive material is described in U.S. Pat. No. 2,970,906 issued to Bixby in 1961. A suitable conductive substrate is aluminum.

Initially, drum 10 rotates photoconductive surface 12 through charging station A. Charging station A employs a corona generating device, indicated generally by the reference numeral 16, to sensitize photoconductive surface 12. Corona generating device 16 is positioned closely adjacent to photoconductive surface 12. When energized, corona generating device 16 charges photoconductive surface 12 to a relatively high substantially uniform potential. For example, corona generating device 16 may be of the type described in U.S. Pat. No. 2,836,725 issued to Vyverberg in 1958.

Thereafter, drum 10 rotates the charged portion of photoconductive surface 12 to exposure station B. Exposure station B includes an exposure mechanism, indicated generally by the reference numeral 18, having a stationary, transparent platen, such as a glass plate or the like, for supporting an original document thereon. Lamps illuminate the original document. Scanning of the original document may be achieved by oscillating a mirror in a timed relationship with the movement of drum 10 or by scanning the lamp and lens system in synchronism therewith across the platen. In either case, the light image of the original document is reflected onto the charged portion of photoconductive surface 12. Irradiating the charged photoconductive surface records an electrostatic latent image corresponding to the informational areas contained within the original document.

Drum 10 next rotates the electrostatic latent image recorded on photoconductive surface 12 to development station C. Development station C includes a developer unit 20 having a housing with a supply of developer mix contained therein. The developer mix comprises carrier granules and toner particles. The carrier granules are formed from a magnetic material with the toner particles being made from a heat-settable plastic. Preferably, developer unit 20 is a magnetic brush development system. In a system of this type, the developer mix is brought through a directional flux field to form a brush thereof. The electrostatic latent image recorded on photoconductive surface 12 is developed by bringing the brush of developer mix into contact therewith. In this manner, the toner particles are attracted electrostatically to the latent image forming a toner powder image on photoconductive surface 12. As the toner particles are depleted from the development system, additional toner particles are furnished thereto by a toner dispensing system. The toner particles are mixed with the developer material so as to form a substantially homogeneous mixture. The cross-mixer for mixing the developer material is described hereinafter with reference to FIG. 3 and the development system with reference to FIG. 2.

With continued reference to FIG. 1, a sheet of support material is advanced by sheet feeding apparatus 22 to transfer station D. Sheet feeding apparatus 22 includes a feed roll 24 contacting the uppermost surface of the stack of sheets of support material 26. Feed roll 24 rotates in the direction of arrow 28 so as to advance the uppermost sheet from stack 26. Registration rollers 30 rotate in the direction of arrow 32, to align and forward the advancing sheet of support material into chute 34. Chute 34 directs the advancing sheet of support material into contact with drum 10 in a timed sequence so that the toner powder image developed thereon contacts the advancing sheet of support material at transfer station D.

At transfer station D, a corona generating device, indicated generally by the reference numeral 36, applies a spray of ions to the backside of the sheet of support material. This attracts the toner powder image from photoconductive surface 12 to the sheet of support material.

After transferring the toner powder image to the sheet of support material, the sheet of support material is advanced to a suitable fuser assembly. Thus, conveyor 38 advances the sheet of support material in the direction of arrow 40 to the fusing assembly, indicated generally by the reference numeral 42, located at fusing station E. Fuser assembly 42 comprises a heated fuser roller 44 and a backup roller 46. The sheet of support material, with the toner powder image thereon, passes between the heated fuser roller 44 and backup roller 46. After the fusing process, the sheet of support material is advanced by a series of rollers 48 to catch tray 50 for subsequent removal therefrom by the machine operator.

Invariably, after the sheet of support material is separated from photoconductive surface 12, some residual toner particles remain adhering thereto. These residual toner particles are removed from photoconductive surface 12 at cleaning station F. Initially, toner particles are brought under the influence of a corona generating device adapted to neutralize the remaining electrostatic charge on photoconductive surface 12 and that of the residual toner particles. Thereafter, the neutralized toner particles are cleaned from photoconductive surface 12 by a rotatably mounted fibrous brush in contact therewith. Subsequent to cleaning, a discharge lamp floods photoconductive surface 12 with light to dissipate any residual electrostatic charge remaining thereon prior to the charging thereof for the next successive imaging cycle.

It is believed that the foregoing description is sufficient for purposes of the present invention to illustrate the general operation of the electrophotographic printing machine shown in FIG. 1. Referring now to the specific subject matter of the present invention, FIG. 2 depicts developer unit 20 in greater detail.

Figure 2:
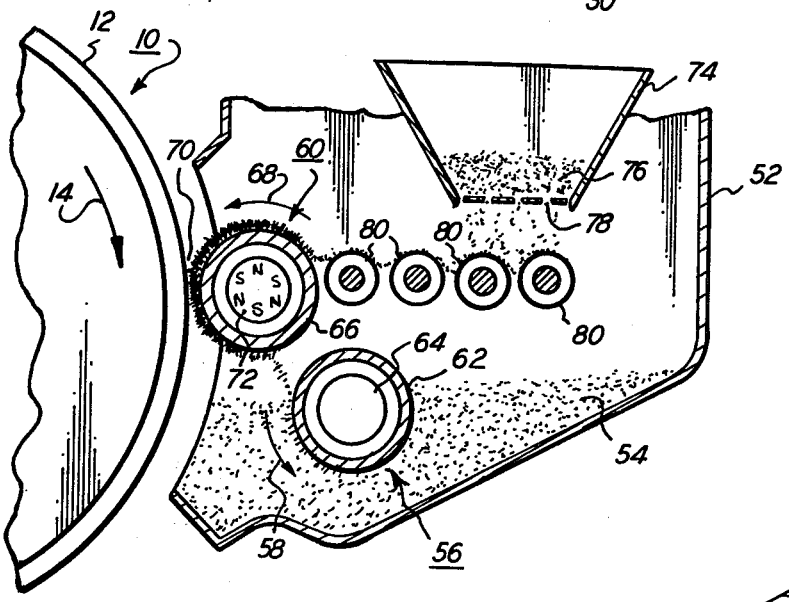
FIG. 2 is a schematic elevational view of a development system employed in the FIG. 1 printing machine.

As shown in FIG. 2, housing 52 has a chamber 54 for storing a supply of developer mix therein. Forwarding roller 56 advances the developer mix from the lowermost portion of chamber 54 to developer roller 60. Forwarding roller 56 comprises an outer cylinder or tubular member 62 made of a non-magnetizable material having a roughened exterior surface and extending almost the length of housing 52. Tubular member 62 is mounted for rotation in housing 52. A magnetic member of cylinder 64 is disposed interiorly of tubular member 62, i.e. tubular member 62 is interfit telescopically over magnetic member 64. Magnetic member 64 has a plurality of magnetic poles impressed about the circumferential surface thereof. Advancement of the developer mix is achieved by magnetically atrracting the developer mix to tubular member 62 which rotates in the direction of arrow 58 while magnetic member 64 remains stationary.

Developer roller 60 comprises a non-magnetizable cylindrical or tubular member 66 having a roughened exterior surface and extending almost the length of housing 52. Tubular member 66 rotates in the direction of arrow 68 to advance the developer material therewith while magnetic member 72 remains stationary. As tubular member 66 rotates in the direction of arrow 68, the developer mix rotates therewith into development zone 70. In this manner, a brush of developer mix extends outwardly from tubular member 66 and contacts photoconductive surface 12. The electrostatic latent image recorded thereon attracts the toner particles from the carrier granules forming a toner powder image on photoconductive surface 12. Tubular member 66 is interfit telescopically over magnetic member 72. Magnetic member 72 has a plurality of poles impressed about the outer circumferential surface thereof. The pole arrangement is such that the developer mix is attracted to tubular member 66 and rotates therewith into development zone 70. After the denuded carrier granules and residual developer mix moves away from development zone 70, they fall from tubular member 66 back into the lower region of chamber 54 of housing 52. Thus, it is evident that additional toner particles are required to be periodically added to chamber 54 of housing 52 so as to maintain optimum copy quality.

Hopper 74 stores a supply of toner particles 76 therein. Hopper 74 has a plurality of apertures 78 in the bottom portion thereof through which toner particles 76 are discharged. In this manner, additional toner particles are dispersed from hopper 74 to chamber 54 of housing 52.

Cross-mixers 80 are submerged in the developer mix and mix the new toner particles with the denuded carrier granules and unused developer mixture. In this manner, a substantially homogeneous developer mixture is achieved. Each cross-mixer 80 moves the foregoing material from one open end portion thereof to the other open end portion opposed thereto. As the material advances through each cross mixer 80, the particles are intermingled with one another to promote the uniformity of the resultant mixture. Cross-mixers 80 are located beneath hopper 74 and in a position to receive the denuded carrier granules and unused developer mix from developer roll 60. The structure of each cross mixer 80 will be described hereinafter with reference to FIG. 3.

Figure 3:
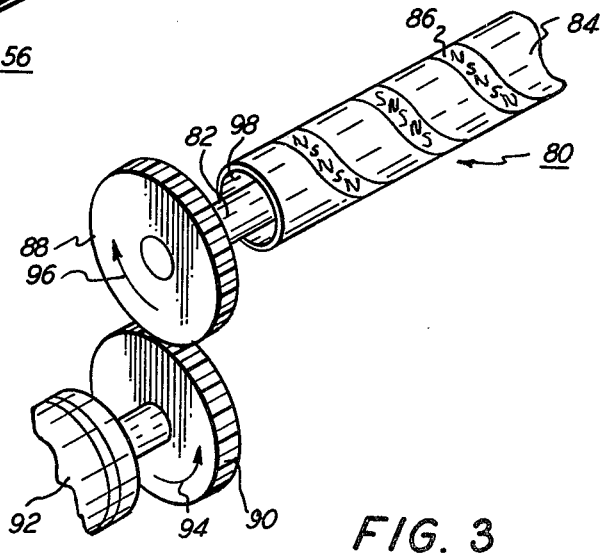
FIG. 3 is a schematic perspective view of the cross-mixer used in the FIG. 2 development system.

As shown in FIG. 3, cross-mixer 80 comprises an inner tube 82 preferably made from an elastomeric material, such as plastic, having a roughened or striated interior surface. An outer hollow cylinder 84 is positioned concentrically over tube 82 and spaced therefrom. Space 98 permits cylinder 84 to be mounted stationarily in chamber 54 of housing 52 with tube 82 being mounted rotatably therein. A helical magnetic pole pattern 86 is impressed about the circumferential surface of cylinder 84. Preferably, the magnetic pole pattern has a 45° pitch, i.e. the helix angle is 45°. By way of example, cylinder 84 may be made from an elastomeric material, such as a plastic, having a magnetic material, such as a ferrite, impregnated therein. Alternatively, cylinder 84 may be made from a non-magnetic outer shell, such as a plastic, secured to a magnet inner shell. The magnet inner shell is concentric with the outer shell having its exterior circumferential surface in contact with the interior circumferential surface of the outer shell. In either of the foregoing embodiments, a helical magnetic pole pattern is impressed on the outer cylinder. Inner tube 82 has one end portion thereof coupled to gear 88. Gear 88 meshes with gear 90 mounted on drive motor 92. Motor 92 rotates gear 90 in the direction of arrow 94. As gear 90 rotates in the direction of arrow 94, gear 88 rotates in the direction of arrow 96. Toner particles, denuded carrier granules, and unused developer mix translate in longitudinal direction along the interior surface of inner tube 82. Thus, as inner tube 82 rotates in the direction or arrow 96, the foregoing material is advanced in a longitudinal direction due to the roughened interior surface of inner tube 82 coacting with the helical pole pattern 86 of outer cylinder 84. This movement from one end of cross-mixer 80 to the other end thereof promotes mixing of the material forming a substantially homogeneous developer mix.

While the invention has been described in connection with rotating the inner tube with the outer cylinder being stationary, one skilled in the art will appreciate that the invention is not necessarily so limited and that the outer tube may rotate with the inner tube remaining stationary.

In recapitulation, it is apparent that pursuant to the present invention, as heretofore described, the cross-mixer promotes mixing of the particles employed in a development system of an electrophotographic printing machine. This is achieved by employing a cross-mixer comprising an inner tube having a roughened surface disposed interiorly of a stationary outer cylinder having a helical magnetic pole pattern impressed thereon. As the inner tube rotates, the developer material disposed in the inner tube translate from one end to the other end thereof. This axial movement mixes the material forming a substantially homogeneous developer material.

It is, therefore, evident that there has been provided in accordance with the present invention, an apparatus for mixing the developer material employed in the development system of an electrophotographic printing machine. The cross-mixer of the present invention fully satisfies the objects, aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as may fall within the spirit and broad scope of the appended claims.

What is claimed is:

1. An apparatus for developing an electrostatic latent image recorded on a photoconductive surface, including:

means for advancing a developer mix of carrier granules and toner particles closely adjacent to the latent image so as to attract the toner particles from the carrier granules to the latent image;

means for furnishing additional toner particles to the developer mix; and means for mixing the toner particles with the carrier granules, said mixing means comprising an inner member having the particles disposed thereon, an outer member positioned concentrically over the inner member and defining a space therebetween, the outer member having a helical magnetic pole pattern impressed thereon, and means for generating relative angular rotation between the inner member and the outer member to translate the developer mix disposed on the inner member.

2. An apparatus as recited in claim 1, wherein the inner member of said mixing means includes an elongated non-magnetic tubular member.

3. An apparatus as recited in claim 2, wherein the outer member of said mixing means includes an elongated hollow cylindrical member.

4. An apparatus as recited in claim 3, wherein the generating means rotates the tubular member with the cylindrical member being stationary.

5. An apparatus as recited in claim 3, wherein the cylindrical member includes an elastomeric shell having a magnetizable material impregnated therein in a helical configuration.

6. An apparatus as recited in claim 3, wherein the helical magnetic pole pattern has a helix angle preferably of about 45°.

* * * * *